United States Patent [19]

Manwell et al.

[11] Patent Number: 4,930,757

[45] Date of Patent: Jun. 5, 1990

[54] TUYERE FOR METALLURGICAL VESSELS

[75] Inventors: Robert E. Manwell; Charles A. Sutherland, both of Trail, Canada

[73] Assignee: Cominco Ltd., Vancouver, Canada

[21] Appl. No.: 416,198

[22] Filed: Oct. 2, 1989

[51] Int. Cl.[5] ..... C21C 5/48

[52] U.S. Cl. ..... 266/270; 266/87; 266/218; 266/268

[58] Field of Search ..... 266/87, 218, 267, 268, 266/270

[56] References Cited

U.S. PATENT DOCUMENTS

| | | | |
|---|---|---|---|
| 2,827,279 | 3/1958 | Cox | 266/270 |
| 3,794,308 | 2/1974 | Ponghis et al. | 266/270 |

FOREIGN PATENT DOCUMENTS

| | | | |
|---|---|---|---|
| 2355305 | 5/1975 | Fed. Rep. of Germany | 266/270 |
| 1437404 | 11/1988 | U.S.S.R. | 266/270 |

*Primary Examiner*—Robert McDowell
*Attorney, Agent, or Firm*—Arne I. Fors

[57] ABSTRACT

A tuyere for a metallurgical vessel comprising a solid metal tuyere body with a central gas feed bore. The gas feed bore contains at least one gas feed pipe. The tuyere body also has at least one water-cooled bore between the outer wall of the tuyere body and the gas feed bore. A water-cooled bore has a water passage for circulating water therethrough. A water cooling header with separated water inlet and outlet is attached to the tuyere body external to the metallurgical vessel. A water passage is provided for a flow of water from the water inlet through the water passage in the water-cooled bore to the water outlet. The cooling capacity of the tuyere is sufficient to cause the formation of a protective encrustation on the end of the tuyere, and to effectively reduce erosion and chemical reaction of the tuyere material and the vessel wall.

21 Claims, 3 Drawing Sheets

TUYERE FOR METALLURGICAL VESSELS

BACKGROUND OF THE INVENTION

This invention relates to tuyeres for metallurgical vessels and, more particularly, to submerged gas tuyeres used in smelting and refining vessels.

Many metallurgical operations are carried out at high temperatures in refractory-lined furnaces provided with one or more submerged gas tuyeres through which oxidizing, reducing or inert gases are supplied to the furnace charge.

As maintenance of the furnace lining and replacement of tuyeres, mainly as a result of erosion and chemical reaction, are major costs, much effort is spent on the design of tuyeres. A common method for alleviating deterioration problems is by cooling the furnace wall and the tuyeres, such as by using cooling fluids, shielding fluids or solid cooling elements, or by using protective sheaths, coatings or the like. Protection is also provided by causing a porous encrustation of solid material to build up at the tip of the tuyere.

BRIEF DESCRIPTION OF PRIOR ART

The prior art on cooling furnace walls and on gas injectors such as tuyeres and lances is extensive. The following patents are recited by way of examples. Water cooling of refractory furnace linings is disclosed in U.S. Pat. Nos. 1 703 519, 3 593 975, 3 598 382, 3 679 194 and 3 843 106. The use in a furnace wall of solid or annular cooling members, of which a portion external to the wall may be cooled, is disclosed in CA Pat. No. 1 006 695. The use of copper tubes in a refractory wall is disclosed in U.S. Pat. No. 2 829 879. Examples of the use of a protective fluid with a concentric-tube injector can be found in U.S. Pat. Nos. 3 397 878, 3 706 549, 3 988 148, 4 251 271, 4 417 723, 4 424 955, 4 435 211, 4 449 701, 4 734 129, 4 759 532, 4 792 126 and 4 795 138, in CA Pat. No. 1 141 168, and in SU Pat. No. 500 239. The formation of a protective layer or encrustation on the furnace wall or at the gas injector is disclosed in some of the above-named patents. The use of a refractory, refractory-coated, -sheathed or -filled pipe for an injector is disclosed in U.S. Pat. Nos. 3 395 910, 4 417 723, 4 783 057 and 4 783 058. A fluid-cooled tuyere having a cooling chamber for circulating fluid and an adjacent solid heat-sink wall is disclosed in U.S. Pat. No. 4 572 482. According to SU Pat. No. 452 599, a tuyere has a nozzle with an expansion chamber filled with aluminum and adjacent a fluid-cooled housing; life is enhanced by a crystallized metal layer formed on the outside surface of the nozzle.

The injectors of the prior art have a number of important disadvantages. The use of water for cooling requires extreme caution as any leaking of water into the high-temperature furnace charge may cause explosions. The use of solid cooling elements is subject to a fixed rate of heat transfer, and is also dependent on the thermal conductivity of the solid material. Any protective sheaths or coatings on a tuyere are subject to erosion when exposed to high-temperature furnace contents. Many of the prior art lances and tuyeres extend through the wall of the furnace into its contents, and are, therefore, subject to chemical or erosive physical attack.

SUMMARY OF THE INVENTION

We have now found that the erosion of the furnace lining and of a submerged gas tuyere may be alleviated by using a solid metal tuyere body provided with a number of water-cooled bores and a central gas feed pipe. The tuyere is embedded in refractory and the tip or end of the tuyere is flush with the inner wall so that no part of the tuyere except its terminal surface is exposed to the furnace contents. The mass of the tuyere body and the watercooling of the water-cooled bores in the body together provide cooling that is effective in reducing erosion of the furnace refractory wall and the tuyere.

The tuyere comprises a solid metal tuyere body of a, preferably, generally cylindrical shape and with a good thermal conductivity. The tuyere body has a central gas feed bore and a number of circumferentially-located water-cooled bores. The central gas feed bore contains a gas feed pipe, which is connected at one end with a source of gas, its other end being substantially flush with the end surface of the tuyere body. Alternatively, the central gas feed bore contains a gas feed inner pipe and a concentric shielding gas outer pipe spaced from each other to provide an annulus between the pipes for passing a shielding gas.

Each water-cooled bore extends partially into the tuyere body leaving sufficient (unbored) material of the tuyere body to provide safe operation. Each water-cooled bore is provided with means to provide a water passage for circulating water along the length of the water-cooled bore so that water fed into the bore passes to the end of the bore and returns in the bore to its other end. In a preferred embodiment, each bore is provided with a water cooling pipe spaced from the bore wall so that water fed into the pipe passes to the end of the bore and returns through an annulus between the pipe and its bore.

The tuyere is attached to a cooling header. The cooling header has a central passage for the gas feed pipe or the gas and shielding gas concentric pipes, and has means for providing a water passage for circulating water. In the preferred embodiment, the header has means for attaching each of the cooling water pipes to and in the header. The header provides a passage for cooling water into and through the header, the cooling pipes, the annulus between the water cooling pipes and the water-cooled bores, and through and out of the header According to an alternative embodiment, the water-cooled bore and the cooling header are divided in an inward water passage and a outward water passage by a central plate.

It is an object of the present invention to provide a tuyere for a metallurgical vessel It is another object to reduce erosion of the wall of the metallurgical vessel and the tuyere.

Accordingly, there is provided a tuyere for a metallurgical vessel comprising a tuyere body made of a solid metal; a gas feed bore through said tuyere body on its longitudinal axis; at least one gas feed pipe in said gas feed bore; at least one water-cooled bore in said tuyere body, said water-cooled bore being situated in and partly penetrating into said body parallel to and between the outer wall of said body and said gas feed bore and having a water passage for circulating water along the length of the water-cooled bore; a water cooling header attached to said tuyere body external to said vessel; a water inlet and a water outlet in said cooling header; and means in said cooling header to communicate water from said water inlet to said water passage and from the water passage to said water outlet.

BRIEF DESCRIPTION OF DRAWINGS

The objects of the invention will be apparent from the following description taken in conjunction with the accompanying drawings wherein:

FIG. 3 is a perspective view, partly cut away, of a cooling header in relation to the tuyere of FIG. 2;

FIG. 5 is a perspective view, partly cut-away, of another embodiment of the cooling header.

In the figures, like numbers refer to like parts.

DETAILED DESCRIPTION

Figure 1:
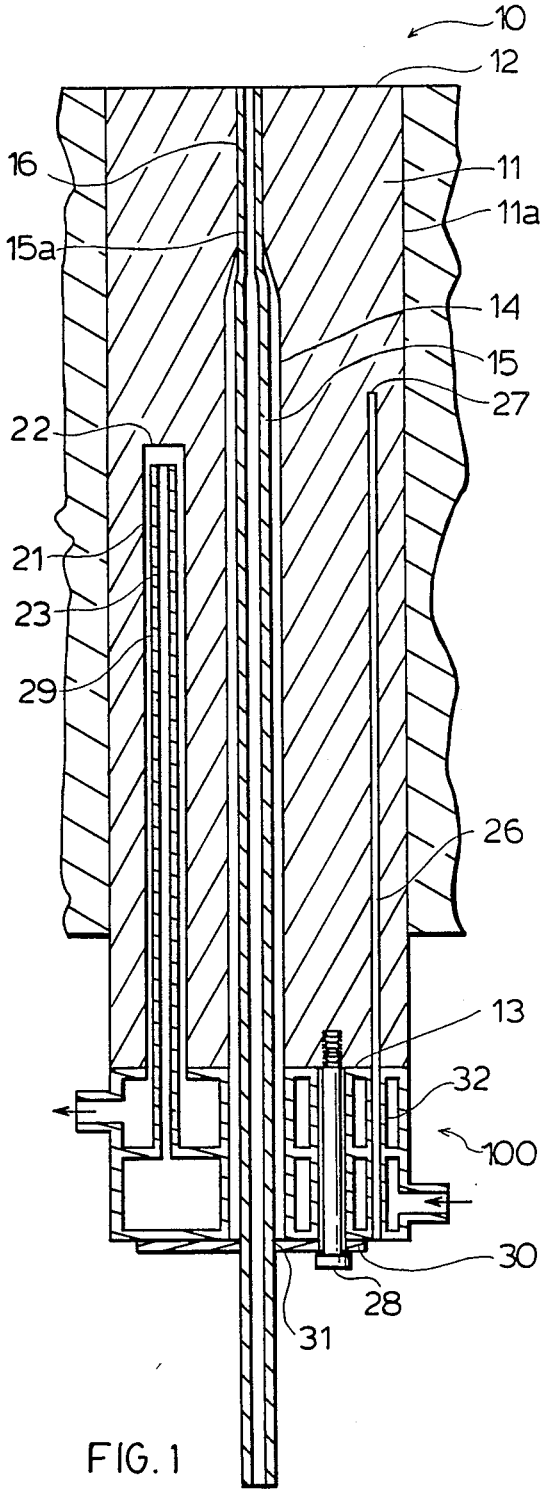
FIG. 1 is a section of a tuyere according to the invention.
Figure 2:
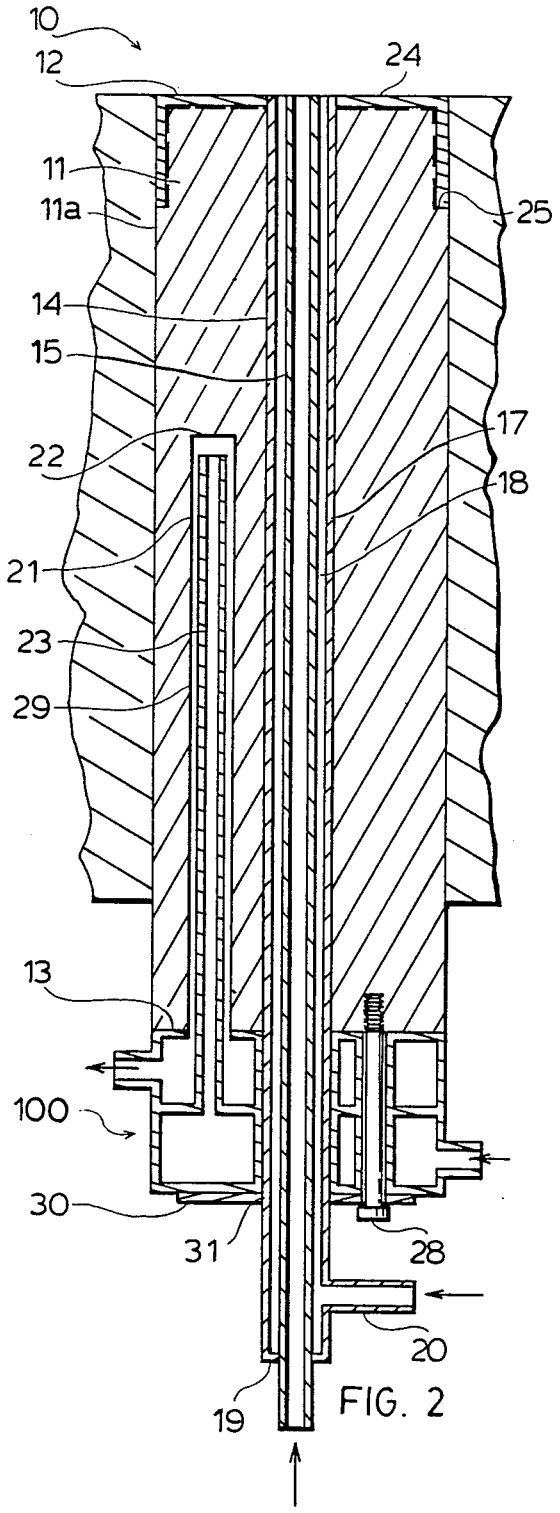
FIG. 2 is a section of an alternative embodiment of the tuyere as shown in FIG. 1.

With reference to FIGS. 1 and 2, the tuyere, generally indicated with 10, comprises a generally cylindrically-shaped tuyere body 11. Although the description is made with reference to a generally cylindrically-shaped tuyere body, it is understood that other shapes such as square or tapered bodies symmetrical about their longitudinal axes can also be used. The tapered bodies may be tapered over the full or partial lengths of the bodies towards end face 12. Tuyere body 11 is a solid body made of a metal. The criteria for the choice of metal for the tuyere body are good thermal conductivity and a high resistance to oxidation. Suitable metals are, for example, copper, certain copper alloys, or stainless steels. Tuyere body 11 has two opposite, substantially flat end faces 12 and 13 perpendicular to its longitudinal axis.

Tuyere body 11 has a central gas feed bore 14 adapted to contain the gas feed pipe 15. Gas feed bore 14 may have the same diameter all the way through tuyere body 11 as shown in FIG. 2, or may have a smaller diameter terminal section 16 over a short portion of its length at end face 12, as shown in FIG. 1. Gas feed pipe 15 is inserted in gas feed bore 14 such that one end is substantially flush with end face 12, and its other end extends past the opposite end face 13 where it is connected to a source of gas (not shown). In the tuyere body of FIG. 1, one end of gas feed pipe 15 fittingly inserts in and passes through terminal section 16 of gas feed bore 14. If desired, gas feed pipe 15 may have a smaller diameter terminal nozzle portion 15*a* through terminal section 16. The other end of gas feed pipe 15 is maintained in fixed position with relation to gas feed bore 14 by pressure plate 30, to be described. As shown in FIG. 2, gas feed bore 14 contains an outer shield gas feed pipe 17. Gas feed pipe 15 is concentrically positioned in outer shield gas feed pipe 17, leaving a shield gas annulus 18 for shield gas between the inner wall of shield gas feed pipe 17 and the outer wall of gas feed pipe 15. Shield gas feed pipe 17 has one open end substantially flush with end face 12 of tuyere body 11, and has a closed end 19 around the end of gas feed pipe 15 extending beyond tuyere face 13. Close to end 19 of shield gas feed pipe 17, pipe 17 has a connection 20 connected to a source of shield gas (not shown). Gas feed pipe 15 is maintained in fixed and spaced relation to shield gas feed pipe 17 by tack welds along its length.

Tuyere body 11 has at least one water-cooled bore 21, as shown, penetrating partly into body 11 parallel to and between outer wall 11*a* of the body and gas feed bore 14. More than one bore 21 may be present such as, for example, three water-cooled bores 21 concentrically located to gas feed bore 14. The bores are preferably equally spaced. Water-cooled bore 21 has a bottom 22, and has a depth sufficient to provide adequate cooling while also providing sufficient mass of the tuyere body between bottom 22 and end face 12 to prevent any water from reaching the furnace charge. Each water-cooled bore 21 is provided with a water passage for circulating water along the length of the bore. In one embodiment of the invention, water-cooled bore 21 may be provided with a longitudinal central plate 40 (FIG. 5). Plate 40 substantially divides bore 21 into two halves which form outward water passage 41 and inward water passage 42 substantially along the length of bore 21, passages 41 and 42 being connected to each other in proximity to and spaced from end 22 to form a continuous water passage through bore 21. In a preferred embodiment, (FIGS. 3 and 4) the water passage is provided by a water cooling pipe 23 inserted in spaced relation into water-cooled bore 21 almost to the bottom 22 of bore 21, such that a water passage in the form of a cooling water annulus 29 is provided between the wall of pipe 23 and bore 21, and a space is provided between the one end of pipe 23 and bottom 22 of bore 21. The other end of water cooling pipe 23 is held in fixed, spaced relation in bore 21 by water cooling header 100, to be described. The diameter of the water-cooled bore 21 and water cooling pipe 23 are chosen such that an adequate flow of water ca be provided that supplies the desired degree of cooling. The cross section of tuyere body 11 should be at least sufficient for accomodating the gas feed bore 14 and at least one water-cooled bore 21, with inserted gas feed pipe 15 or gas feed pipe 15 and shield gas feed pipe 17, and water cooling pipe 23, respectively, while providing a sufficient mass for effective cooling as well as continuous, safe operation.

The length of tuyere body 11 is such that the body passes through the refractory wall of the metallurgical vessel, end face 12 being substantially flush with the inner surface of the vessel wall, and end face 13 protruding some small distance beyond and outside the surface of the outer vessel wall.

Suitable means (not shown) are provided to mount the tuyere 10 onto the furnace, the tuyere fittingly passing through the refractory of the vessel wall. Optionally, the tuyere body may be provided with an end cap 24, as shown with interrupted lines in FIG. 2. End cap 24 may be shrunkfit over the end of tuyere body 11. If desired, a portion of tuyere body 11 may be machined to provide a shoulder 25 to accommodate end cap 24. An end cap may be provided in cases wherein the material being treated in the metallurgical vessel is not conducive to the formation of a suitable encrustation on the end of the tuyere.

Tuyere 10 may also be provided with a thermocouple well 26, as shown in FIG. 1, to hold a thermocouple (not shown) for measuring the temperature of the tuyere body 11 at a point in the tuyere body 11 indicated with 27, the point being preferably located between the bottom 22 of a water-cooled bore 21 and the face 12 of the tuyere. Tuyere body 11 is attached to a water cooling header 100, to be described, by means of a pressure plate 30 and fastening means.

With reference to FIG. 3, the water cooling header 100 is adapted for the feeding of cooling water to the water-cooled bore 21 in tuyere body 11. Header 100 has means for the gas feed pipe 15 and the shield gas feed pipe 17 to pass through the header. A thermo couple passage 32 is provided in and through header 100 which is in alignment with thermocouple well 26 in tuyere body 11. Header 100 is attached to the tuyere body 11 by pressure plate 30 and fastening means such as studs or bolts 28 threaded into tuyere body 11. Pressure plate 30 has a central opening 31 for fittingly holding gas feed pipe 15 (FIG. 1) or shield gas feed pipe 17 (FIG. 2) which pass through opening 31. Water cooling header 100 may be of a cast or welded construction, and has generally the same shape as the cross section of tuyere body 11.

Water cooling header 100 consists of an inner header plate 101, a centre header plate 102 and an outer header plate 103, inner plate 101 being located adjacent tuyere body 11. The inner header plate 101 and the outer header plate 103 are attached to or integral with the end of a header body 104 in parallel spaced relation, and centre header plate 102 is in header body 104 intermediate and parallel to the inner and outer plates 101 and 103. Centre header plate 102 provides means to physically separate water flowing into the header from water flowing from the header, as will be explained. Centrally in and passing through the parallel plates 101, 102 and 103 is a central gas feed pipe passage 105 adapted to contain the gas feed pipe 15 or the outer shield gas feed pipe 17 with gas feed pipe 15 therein. The diameter of pipe passage 105 is substantially the same as the diameter of central gas feed bore 14 in tuyere body 11

A water inlet 106 is suitably located on the circumference and through the wall of and in header body 104 between outer header plate 103 and centre header plate 102. Water inlet 106 is connected to a source of cooling water (not shown). A water outlet 107 is provided on the circumference and through the wall of and in header body 104 between centre header plate 102 and inner header plate 101. Water outlet 107 is connected to means (not shown) for discharging water from header 100. Water inlet 106 and outlet 107 may be suitably located anywhere on the circumference of header body 104.

According to the preferred embodiment, water cooling header 100 is provided with attachment means generally indicated with 108 in an opening **108*a* in centre plate 102 for attachment of the at least one water cooling pipe 23. Attachment means 108 comprises, preferably, a half coupling 109 in opening 108*a* in the peripheral portion 110 of centre plate 102. Half coupling 109 is provided with a threaded portion 111 for attachment of the threaded mating end of a water cooling pipe 23. In case of more than one water cooling pipe, the half couplings 109 are evenly spaced in the peripheral portion 110 of centre plate 102 around pipe 105. Opening 112 corresponding and in axial alignment with half coupling 109 is provided in the peripheral portion of inner header plate 101 so that water cooling pipe 23 attached to half coupling 109 passes through inner header plate 101. Opening 112 has the same diameter as that of a water-cooled bore 21 in the tuyere body 11, leaving an annulus 29** for cooling water.

Preferably, tuyere body 11 has three water-cooled bores 21, the centres of bores 21, corresponding with centre lines through openings **108*a* with half couplings 109 and openings 112, being equally spaced on a circle concentric to the longitudinal axis of the tuyere Water cooling header 100 is attached to tuyere body 11 by means of pressure plate 30 and suitable fastening means such as studs or bolts 28. The fastening means each pass through pipe nipples 113 attached to or integral with and through plates 101, 102 and 103. Preferably, three fastening means are used, their centre lines being on the same circle as the centre lines through half couplings 109 and openings 112 for water cooling pipes 23, the fastening means with nipples 113 and the water cooling pipes 23** alternating at equal distances.

To obtain a water-tight connection between cooling header 100 and tuyere body 11, a groove 114 is provided in the surface of inner header plate 101 adjacent tuyere body 11 and around each of the openings 112 for holding an "O" ring (not shown). When cooling header 100 is attached to tuyere body 11 by tightening the pressure plate with the fastening means, the "O" rings provide a water-tight connection.

A sealed water inlet chamber 115 is formed in header body 104 between the inner wall of body 104, centre plate 102 and outer plate 103, water ingress being provided by water inlet 106 and water egress through attachment means 108. A sealed water outlet chamber 116 is formed in header body 104 between the inner wall of body 104, centre plate 102 and inner plate 101, water ingress being provided by annulus 29 in opening 112 and water egress through water outlet 107. This construction physically separates water inlet 106 from outlet 107. A continuous water passage 117, schematically indicated with an arrowed line, is formed from water inlet 106 into water inlet chamber 115, through attachment means 108, through water cooling pipe 23, cooling water annulus 29, and through water outlet chamber 116 to water outlet 107. If desired, the direction of water through water passage 117 may be reversed.

According to an alternative embodiment (FIG. 5) of the means in cooling header 100 to communicate water from water inlet 106 through the water passage and from the water passage to water outlet 107, longitudinal central plate 40 in water-cooled bore 21 extends into header 100 through openings 112 and **108*a*. Openings 108*a* and 112 are provided with a pipe nipple 43 attached in and to or integral with the openings and between plates 101 and 102. The end 44 of pipe nipple 43 in opening 108*a* is half closed at 45 and half open at 46 so that sealed water chamber 115 is in communication with inward water passage 42. Nipple 43 also has an opening 47 in its side so that outward water passage 41, closed at its end at 45 with a substantially semicircular plate, is in communication with sealed water outlet chamber 116. Water chambers 115 and 116 are thus physically separated and continuous water passage 117 for cooling water is formed from water inlet 106 into chamber 115, through opening 46 into inward water passage 42 to end 22 of bore 21, through outward water passage 41, through opening 47 into water chamber 116 and to water outlet 107**.

As can be seen from the above description, means are provided in the cooling header to communicate water from water inlet 106 to the water passage and from the water passage to water outlet 107

The invention will now be illustrated by means of the following non-limitative examples.

EXAMPLE 1

A tuyere according to the invention described with reference to FIG. 1 was installed in a sidewall near the bottom of a lead softening furnace operating at a temperature of 620° C. The tuyere had a cylindrical copper tuyere body with a length of 387 mm and a diameter of 152 mm. The body had a central gas feed pipe bore with a diameter of 24 mm and a nozzle bore portion with a length of 52 mm and a diameter of 9 mm. The gas feed pipe inserted in the gas feed pipe bore had a diameter of 22 mm outside and 12.7 mm inside, and had a nozzle portion 70 mm long with a 9 mm outside diameter and an inside diameter of 4 mm. The tuyere had a thermocouple well, its end being 75 mm from the face of the tuyere.

The tuyere had three water-cooled bores at 120° spacings, each with a length of 222 mm and a diameter of 26 mm. Water cooling pipes with an inside diameter of 12.7 mm and an outside diameter of 21 mm were inserted in the bores, leaving a space of 5 mm between the end of the pipe and the end of the bore, and leaving an annulus with a width of 2.5 mm between pipe and bore.

The cooling header, attached to the tuyere body with three bolts, was 92 mm long and had a diameter of 168 mm. Threaded ends of the water cooling pipes were fixedly attached in half couplings in the centre plate of the header.

Oxygen was passed through the gas feed pipe at a rate of 12 normal $m^3/h$ and water was passed through the cooling header and the water cooling pipes in the water-cooled bores at a rate of 600 L/h. During operation at these rates, the water inlet temperature was 7° C. and the outlet temperature 17° C. The heat flux at the tuyere end surface was 300,000 $kcal/m^2.h$. The temperature recorded with the termocouple was 210° C. A distinct encrustation was formed on the end of the tuyere. After one month of operation no discernable deterioration of the tuyere was observed, and little erosion of refractory material around the tuyere occurred.

EXAMPLE 2

A submerged bottom tuyere for a QSL lead smelting furnace was constructed as described with reference to FIG. 2. The cylindrical copper tuyere body was 600 mm long with a diameter of 152 mm. The central gas feed bore had a diameter of 38.1 mm. A shield gas feed pipe with an outside diameter of 38.1 mm and an inside diameter of 31.29 mm was fittingly inserted in the gas feed bore. A gas feed pipe with an outside diameter of 29.99 mm and an inside diameter of 24.3 mm was centrally inserted in and tack welded to the shield gas feed pipe, leaving an annulus for the shield gas with a width of 1.3 mm. The tuyere body had three water-cooled bores with a length of 410 mm and a diameter of 26 mm. The water cooling pipes and the cooling header were the same as in the tuyere of Example 1.

It is understood that changes and modifications may be made in the embodiments of the invention without departing from the scope of the appended claims.

We claim:

1. A tuyere for a metallurgical vessel comprising a tuyere body made of a solid metal; a gas feed bore through said tuyere body on its longitudinal axis; at least one gas feed pipe in said gas feed bore; at least one water-cooled bore in said tuyere body, said water-cooled bore being situated in and partly penetrating into said body parallel to and between the outer wall of said body and said gas feed bore and having a water passage for circulating water along the length of the water-cooled bore; a water cooling header attached-to said tuyere body external to said vessel; a water inlet and a water outlet in said cooling header; and means in said cooling header to communicate water from said water inlet to said water passage and from said water passage to said water outlet.

2. A tuyere as claimed in claim 1, wherein said tuyere body has three water-cooled bores at 120° from each other on a centre line concentric to said longitudinal axis of said tuyere body; and wherein said tuyere body has two concentric gas feed pipes in said gas feed bore, the outer gas feed pipe being adapted for feeding a shield gas, and said gas feed pipes passing through said cooling header.

3. A tuyere as claimed in claim 1, wherein said tuyere body has three water-cooled bores at 120° from each other on a centre line concentric to said longitudinal axis of said tuyere body; and wherein said tuyere body has one gas feed pipe in said gas feed bore, said gas feed bore has a smaller diameter terminal section, and said gas feed pipe has a terminal nozzle portion fittingly inserted through said terminal section.

4. A tuyere for a metallurgical vessel comprising a tuyere body made of a solid metal; a gas feed bore through said tuyere body on its longitudinal axis; at least one gas feed pipe in said gas feed bore; at least one water-cooled bore having an uniform diameter along its length in said tuyere body, said water-cooled bore being situated in and partly penetrating into said body parallel to and between the outer wall of said body and said gas feed bore; a water cooling pipe inserted in said water-cooled bore, said pipe having a diameter less than the diameter of the water-cooled bore to define an annulus between the water cooling pipe and the water-cooled bore; a water cooling header attached to said tuyere body external to said vessel; a water inlet and a water outlet in said cooling header; means in said cooling header to communicate said inlet with one of said pipe and said annulus; and means in said cooling header to communicate said outlet with the other of said pipe and said annulus to form a continuous water passage.

5. A tuyere as claimed in claim 2, wherein said cooling header comprises an inner header plate, a centre header plate and an outer header plate in parallel spaced-apart relation to a header body forming a separate sealed water inlet chamber and a sealed water outlet chamber, said inner header plate being adjacent an end face of said tuyere body; a central gas feed pipe passage through said inner-, centre- and outer-header plates for said at least one gas feed pipe; said water inlet being provided in said header body and in said water inlet chamber, and said water outlet being provided in said header body and in said water outlet chamber, said water inlet being between said inner plate and said centre plate, and said water outlet being between said centre plate and said outer plate; at least one opening in said inner plate between said central gas feed pipe passage and said header body; means in said centre plate having an axis parallel to the longitudinal axis of the tuyere body and having a central opening for attaching said water cooling pipe to said centre plate, the axes of said means in said centre plate, said opening in said inner plate and said water cooling pipe being coaxial; at least one pipe nipple for receiving fastening means for attaching said cooling header to said tuyere body, said pipe nipple passing through said inner-, centre- and outer-header plates between said central gas feed pipe passage and said header body; and said water passage being from said water inlet into said water inlet chamber, through said means for attaching said water cooling pipe, said water-cooled bore, said opening in said inner plate, and through said water outlet chamber to said water outlet.

6. A tuyere as claimed in claim 4, wherein said tuyere body has three water-cooled bores at 120° from each other on a centre line concentric to said longitudinal axis of said tuyere body.

7. A tuyere as claimed in claim 4, wherein said tuyere body has two concentric gas feed pipes in said gas feed bore, the outer gas feed pipe being adapted for feeding a shield gas, and said gas feed pipes passing through said cooling header.

8. A tuyere as claimed in claim 4, wherein said tuyere body has one gas feed pipe in said gas feed bore, said gas feed bore has a smaller diameter terminal section, and said gas feed pipe has a terminal nozzle portion fittingly inserted through said terminal section.

9. A tuyere as claimed in claim 4, wherein said tuyere body is provided with a thermocouple well.

10. A submerged gas tuyere for a metallurgical vessel, said vessel having a refractory wall comprising an inner surface and an outer surface, said tuyere comprising a tuyere body of a solid metal having a good thermal conductivity and a high resistance to oxidation, said body having an outer wall and two end faces, one end face of said body being substantially flush with the inner surface of said refactory wall, the other end face of said body being outside of the outer surface of said refractory wall, a central gas feed bore through said tuyere body along its longitudinal axis; at least one gas feed pipe having two ends, said gas feed pipe being positioned in said gas feed bore such that one end is substantially flush with the inner surface of said refractory wall; at least one water-cooled bore in said other end face of said tuyere body penetrating partly into said body parallel to and between the outer wall of said body and said central gas feed bore; a water-cooling pipe inserted in said water-cooled bore; a cooling water annulus between said water cooling pipe and the wall of said water-cooled bore; a water cooling header fixedly attached to said other end face of said tuyere body; a water inlet and a water outlet in said cooling header; means in said cooling header to physically separate said water inlet from said water outlet; means for attaching said water cooling pipe to said means in said cooling header to separate said water inlet from said water outlet; a central gas feed pipe passage in said cooling header; and means to communicate water in a continuous water passage from said water inlet through said water cooling pipe and said cooling water annulus to said water outlet.

11. A tuyere as claimed in claim 10, wherein said cooling header comprises an inner header plate, a centre header plate and an outer header plate in parallel spaced-apart relation to a header body forming a separate sealed water inlet chamber and a sealed water outlet chamber, said inner header plate being adjacent an end face of said tuyere body; a central gas feed pipe passage through said inner-, centre- and outer-header plates for said at least one gas feed pipe; said water inlet being provided in said header body and in said water inlet chamber, and said water outlet being provided in said header body and in said water outlet chamber, said water inlet being between said inner plate and said centre plate, and said water outlet being between said centre plate and said outer plate; at least one opening in said inner plate between said central gas feed pipe passage and said header body; means in said centre plate having an axis parallel to the longitudinal axis of the tuyere body and having a central opening for attaching said water cooling pipe to said centre plate, the axes of said means in said centre plate, said opening in said inner plate and said water cooling pipe being coaxial; at least one pipe nipple for receiving fastening means for attaching said cooling header to said tuyere body, said pipe nipple passing through said inner-, centre- and outer-header plates between said central gas feed pipe passage and said header body; and said water passage being from said water inlet into said water inlet chamber, through said means for attaching said water cooling pipe, said water-cooled bore, said opening in said inner plate, and through said water outlet chamber to said water outlet.

12. A tuyere as claimed in claim 10 wherein said tuyere body has three water-cooled bores at 120° from each other on a centre line concentric to said longitudinal axis of said tuyere body.

13. A tuyere as claimed in claim 10, wherein said tuyere body has two concentric gas feed pipes in said gas feed bore, the outer gas feed pipe being adapted for feeding a shield gas, and said gas feed pipes passing through said cooling header.

14. A tuyere as claimed in claim 10, wherein said tuyere body has one gas feed pipe in said gas feed bore, said gas feed bore has a smaller diameter terminal section, and said gas feed pipe has a terminal nozzle portion fittingly inserted through said terminal section.

15. A tuyere as claimed in claim 10, wherein said tuyere body is provided with a thermocouple well.

16. A submerged gas tuyere for a metallurgical vessel, said vessel having a refractory wall comprising an inner surface and an outer surface, said tuyere comprising a tuyere body of a solid metal having a good thermal conductivity and a high resistance to oxidation, said body having an outer wall and two end faces, one end face of said body being substantially flush with the inner surface of said refactory wall, the other end face of said body being outside of the outer surface of said refractory wall, a central gas feed bore through said tuyere body along its longitudinal axis; at least one gas feed pipe having two ends, said gas feed pipe being positioned in said gas feed bore such that one end is substantially flush with the inner surface of said refractory wall; at least one water-cooled bore in said other end face of said tuyere body penetrating partly into said body parallel to and between the outer wall of said body and said central gas feed bore; a longitudinal central plate inserted in said water-cooled bore substantially dividing said bore into two halves to form an inward water passage and an outward water passage substantially along the length of said water cooled bore; a water cooling header fixedly attached to said other end face of said tuyere body; a water inlet and a water outlet in said cooling header; means in said cooling header to physically separate said water inlet from said water outlet; means for attaching said longitudinal central plate to said means in said cooling header, said longitudinal central plate extending into said cooling header such as to separate said water inlet from said water outlet; a central gas feed pipe passage in said cooling header; and means to communicate water in a continuous water passage from said water inlet through said halves formed in said water-cooled bore by said central plate to said water outlet.

17. A tuyere as claimed in claim 16, wherein said cooling header comprises an inner header plate, a centre header plate and an outer header plate in parallel spaced-apart relation to a header body forming a separate sealed water inlet chamber and a sealed water outlet chamber, said inner header plate being adjacent an end face of said tuyere body; a central gas feed pipe passage through said inner-, centre- and outer-header plates for said at least one gas feed pipe; said water inlet being provided in said header body and in said water inlet chamber and said water outlet being provided in said header body and in said water outlet chamber, said water inlet being between said inner plate and said centre plate, and said water outlet being between said centre plate and said outer plate; at least one opening in said inner plate between said central gas feed pipe passage and said header body; an opening in said centre plate corresponding and coaxial with each opening in said inner plate, said coaxial openings in said inner plate and said centre plate being coaxial with said water-cooled bore; a pipe nipple in said coaxial openings in said inner plate and said centre-header plate; said longitudinal central plate extending into and through said nipple creating an inward water passage and an outward water passage; a semicircular plate in said pipe nipple closing said outward water passage at said centre-header plate; an opening in the wall of said nipple between said inner plate and said centre plate to provide communication between said outward water passage and said sealed water inlet chamber; at least one pipe nipple for receiving fastening means for attaching said cooling header to said tuyere body, said pipe nipple for receiving fastening means passing through said inner-, centre- and outer-header plates between said central gas feed pipe passage and said header body; and said water passage being from said water inlet into said water inlet chamber, through said inward water passage, said outward water passage, said opening in said pipe nipple into and through said water outlet chamber to said water outlet.

18. A tuyere as claimed in claim 16, wherein said tuyere body has three water-cooled bores at 120° from each other on a centre line concentric to said longitudinal axis of said tuyere body.

19. A tuyere as claimed in claim 16, wherein said tuyere body has two concentric gas feed pipes in said gas feed bore, the outer gas feed pipe being adapted for feeding a shield gas, and said gas feed pipes passing through said cooling header.

20. A tuyere as claimed in claim 16 wherein said tuyere body has one gas feed pipe in said gas feed bore, said gas feed bore has a smaller diameter terminal section, and said gas feed pipe has a terminal nozzle portion fittingly inserted through said terminal section.

21. A tuyere as claimed in claim 16, wherein said tuyere body is provided with a thermocouple well.

* * * * *

UNITED STATES PATENT AND TRADEMARK OFFICE

CERTIFICATE OF CORRECTION

PATENT NO. : 4,930,757 Page 1 of 3

DATED : June 5, 1990

INVENTOR(S) : Robert E. Manwell, et al

Figure 4:
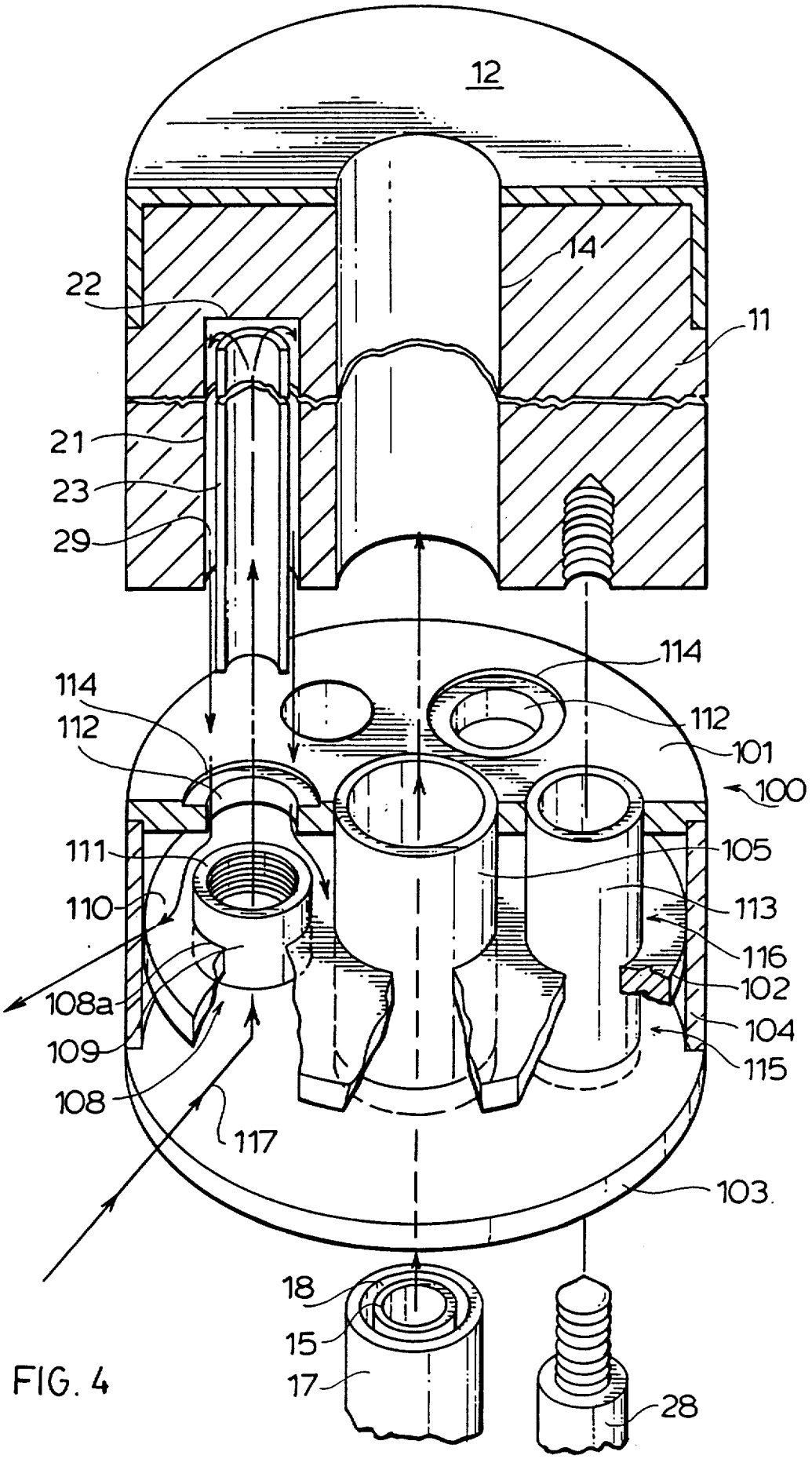
FIG. 4 is an exploded view and a partial cut-away of the cooling header of FIG. 3.

It is certified that error appears in the above-identified patent and that said Letters Patent is hereby corrected as shown below:

On the title page " Drawing sheets" should read --4 Drawing sheets--
Add the sheets of drawings consisting of Figs. 3,4 and 5, as shown on the attached pages.

Signed and Sealed this

Fifteenth Day of January, 1991

*Attest:*

HARRY F. MANBECK, JR.

*Attesting Officer* *Commissioner of Patents and Trademarks*

FIG. 5
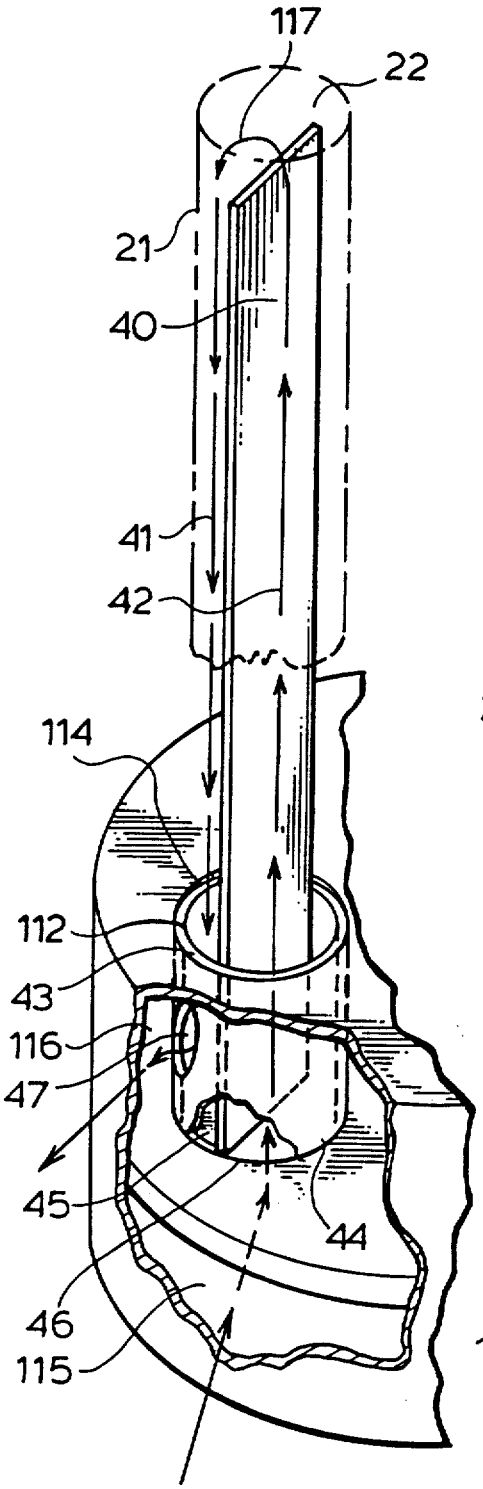
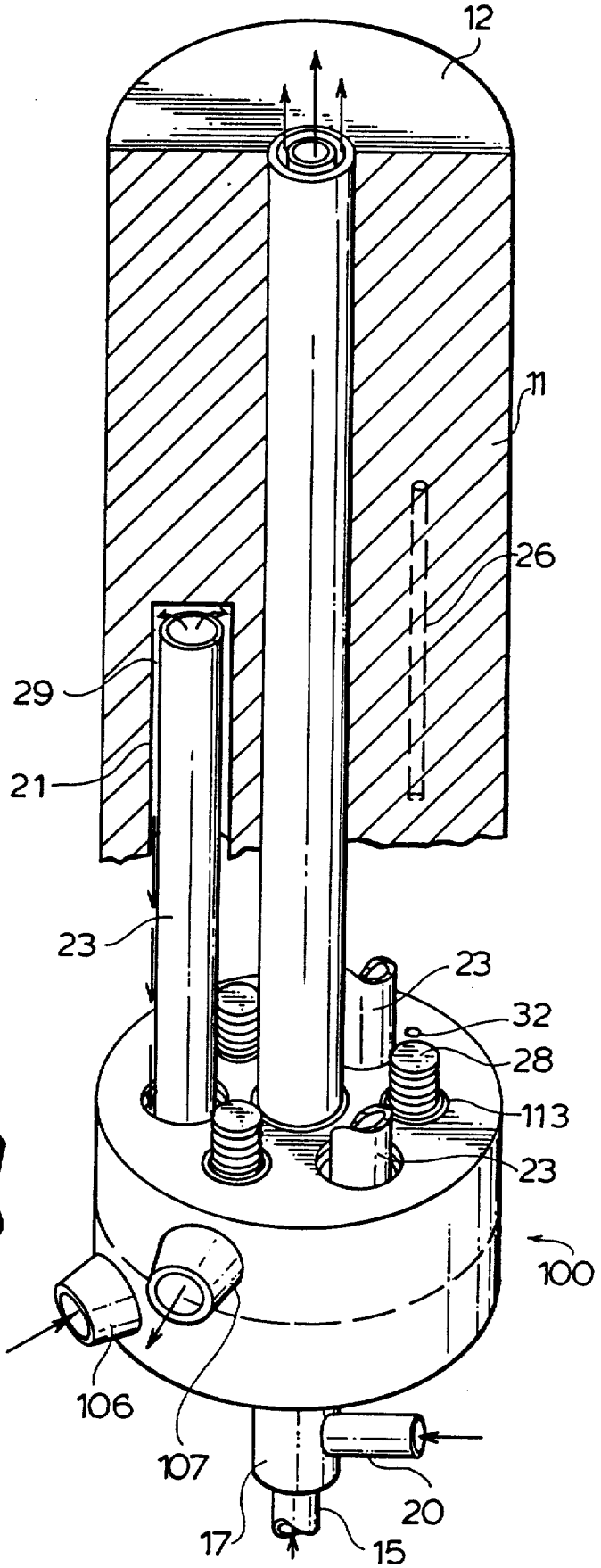
FIG. 3